United States Patent [19]

Hills

[11] 4,403,460

[45] Sep. 13, 1983

[54] METHOD OF ERECTING AN ELEVATED TANK USING FORMWORK

[75] Inventor: Richard E. Hills, Coraopolis, Pa.

[73] Assignee: Pittsburgh-Des Moines Corporation, Pittsburgh, Pa.

[21] Appl. No.: 307,640

[22] Filed: Oct. 1, 1981

[51] Int. Cl.[3] ..... E04H 12/30

[52] U.S. Cl. ..... 52/745; 264/33

[58] Field of Search ..... 52/745, 741, 743, 73, 52/127, 122, 192, 194, 245, 246; 264/33, 34; 29/445

[56] References Cited

U.S. PATENT DOCUMENTS

| | | | |
|---|---|---|---|
| 3,073,018 | 1/1963 | Gauthron | 52/73 X |
| 3,705,776 | 12/1972 | Johansson | 264/33 X |
| 4,011,705 | 3/1977 | VanderKlaauw | 52/741 X |
| 4,016,228 | 4/1977 | Schmidt | 264/33 |
| 4,128,610 | 12/1978 | Ahlgren | 264/33 |
| 4,205,949 | 6/1980 | Hanson | 264/33 X |
| 4,312,167 | 1/1982 | Cazaly et al. | 52/745 |

*Primary Examiner*—J. Karl Bell

*Attorney, Agent, or Firm*—Shoemaker and Mattare, Ltd.

[57] ABSTRACT

A tank is constructed and formwork apparatus is attached to that formed tank. The formwork apparatus is used to construct a tank supporting wall and jacking mechanisms included in that formwork apparatus lift the tank as the support wall is being formed so that the tank is carried upwardly by and on the supporting wall as that wall is constructed. The formwork is preferably slipforms.

14 Claims, 10 Drawing Figures

METHOD OF ERECTING AN ELEVATED TANK USING FORMWORK

BACKGROUND OF THE INVENTION

The present invention relates, in general, to elevated tanks and, more particularly, to methods of constructing elevated tanks.

In slipforming, the forms are 3 to 4 feet high, and move upwardly at about one foot per hour either continuously or intermittently continuously. In the latter case, the crew may work on only one shift per day because of economics, or restrictions on noise, or lack of trained people for more than one shift.

In any case, the concrete being exposed at the bottom edge of the form is stiff and of low but sufficient strength to carry the loads applied thereto.

In jumpforming, the same type forms are used, but may be of a greater height and increased strength. The forms are positioned and filled with concrete. The concrete is allowed to set for hours or days until sufficiently strong, and then moved upward and the next portion cast. This process is not of a continuous nature, but intermittent. One jumps the forms upwardly between pours using jacks, or the like, similar to those used in slipforming.

In the present disclosure, terms such as "forming", "formwork", and the like, will be used to include both slipforming and jumpforming. A specific embodiment using slipforming will be presented, but it is to be noted that such embodiment is not intended as a limitation, but is an example only.

Slipforming concrete walls is a well known construction technique. Basically, slipforming comprises positioning a formwork, pouring concrete into the formwork, and then, while the concrete is setting, moving the same formwork upwardly to pour freshly mixed concrete on top of the first concrete. This procedure is repeated until the desired height is attained. The repetition may be continuous from start to finish or intermittently continuous such as may be accomplished during day shifts only. Known slip-forming apparatus uses a self-climbing formwork, and reinforcing steel is placed as the forms move upwardly. This technique has been successfully utilized in construction of buildings, water towers, bridge piers, chimneys, and the like.

Methods of constructing elevated structures are disclosed in U.S. Pat. Nos. 3,201,502, 3,805,369, 4,197,689, 3,092,216, 3,073,018; and U.S. Pat. No. 4,206,162 discloses a method of constructing concrete enclosures using a bottomless form.

All of the known methods of erecting elevated tanks either require the completed tank or the completed parts of the tank to be hoisted onto a completed supporting wall, thereby requiring heavy hoisting equipment, or requiring hoisting jacks to lift the completed tank plus the completed portions of the support wall, thereby again requiring heavy lifting equipment strong enough to support and lift the entire completed assembly.

Also, it is advantageous from a safety and efficiency viewpoint to assemble as much of the structure as close to the ground as possible. In such a case, the structure is fully assembled at or near ground level where access is easier and subsequent concrete placement is done from substantial platforms attached to the slipforms.

Thus, there is need for a method of erecting elevated tanks which does not require the use of extremely heavy hoisting equipment, and which utilizes manpower as close to the ground as is practically feasible.

SUMMARY OF THE INVENTION

The method embodying the teachings of the present invention utilizes formwork in the erection of elevated tanks, and does not require use of extremely heavy hoisting and/or jacking equipment.

In the disclosed method, the forming apparatus is used as the jacking means for moving a tank to a prescribed position. In other words, in the invention disclosed herein, the jacking mechanism of the form apparatus is used to elevate a completed tank concurrently with the forming.

In the method according to the teaching of the present invention, a tank will be erected on a foundation using blocking at the center and falsework around the perimeter. A steel fluted skirt in a preferred embodiment will be erected in place. In the preferred embodiment, when tank erection is complete, a slipforming crew sets up a form under the steel skirt. Yokes are attached rigidly to a base plate of the skirt, and possibly to the skirt itself, then cross braced to the tank bottom. Steel forms can be used, although wood forms can be adequate. Approximately forty small jacks are required in a preferred embodiment of the disclosed method. The jack rods of these jacks are restrained from buckling by a pipe collar located at the yoke and surrounding the jack rod, and holes are drilled in the skirt base plate. Vertical reinforcement bars may also be held in place by the skirt base plate. The latter base plate acts as a template for positioning the jack rods and any vertical reinforcement or anchors. As such it has holes drilled therein to properly locate such elements.

The main advantage of the forming method embodying the teachings of the present invention is that the tank can be fabricated at ground level. Typically, the metal tank will be constructed with the bottom thereof blocked just slightly above foundation level. Another advantage of the method embodying the teachings of the present invention is that only a limited amount of equipment and a small crew have to be transported to the tank erection site. Still other advantages of the disclosed method include the formwork platform, which provides an ideal work deck for installing ladders, blockouts, and painting. The blockouts may be left in the wall to act as supports for subsequent flooring members.

OBJECTS OF THE INVENTION

It is a main object of the present invention to erect an elevated tank without requiring use of heavy hoisting and/or lifting equipment.

It is another object of the present invention to erect an elevated tank using the form jack mechanism as the means of elevating the tank.

It is yet another object of the present invention to reduce the cost and increase the safety of elevated tank construction by building the tank as near the ground as is feasible.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 10 is an elevation view of a slipform joint of the FIG. 9 embodiment.

DETAILED DESCRIPTION OF THE INVENTION

Figure 1:
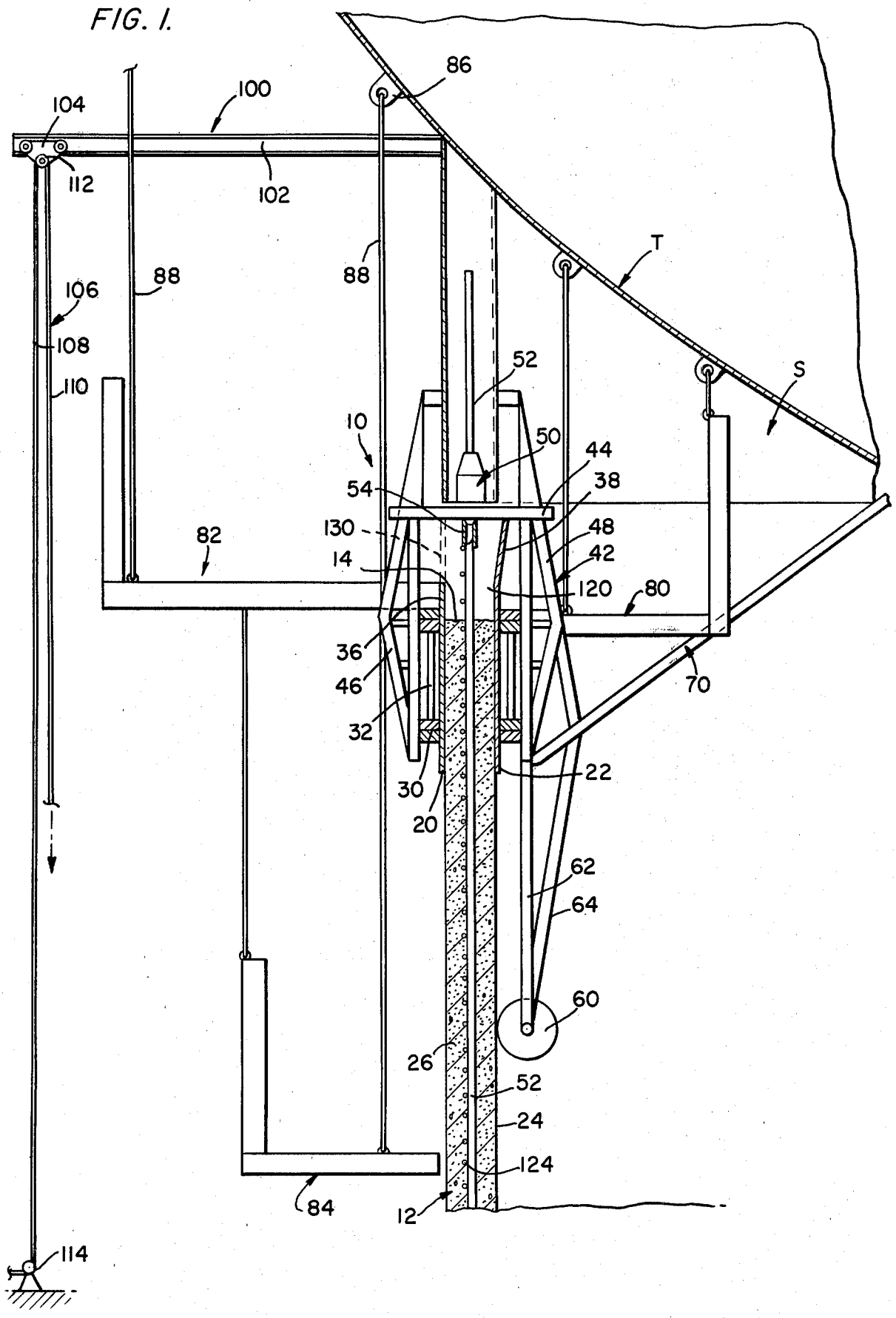
FIG. 1 is an elevated cross-sectional view of the slipforming apparatus used in the method embodying the teachings of the present invention.
Figure 7:
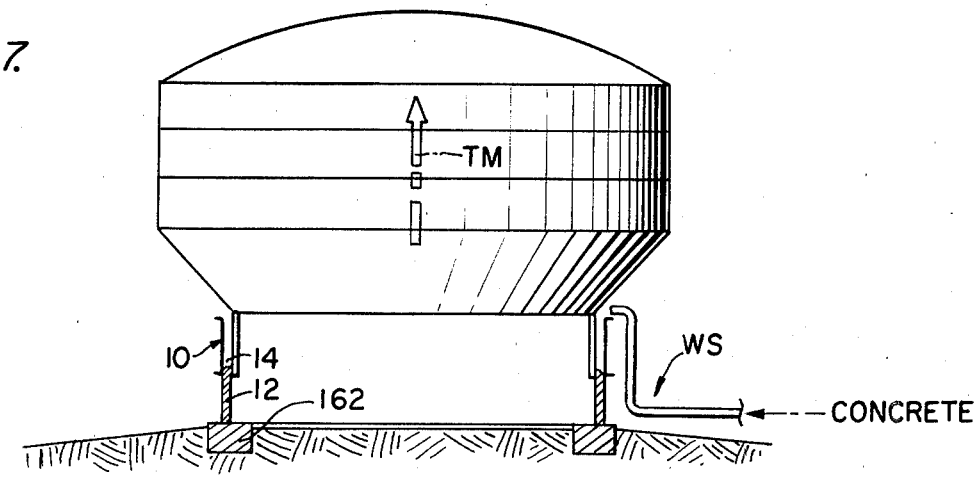
Figure 8:
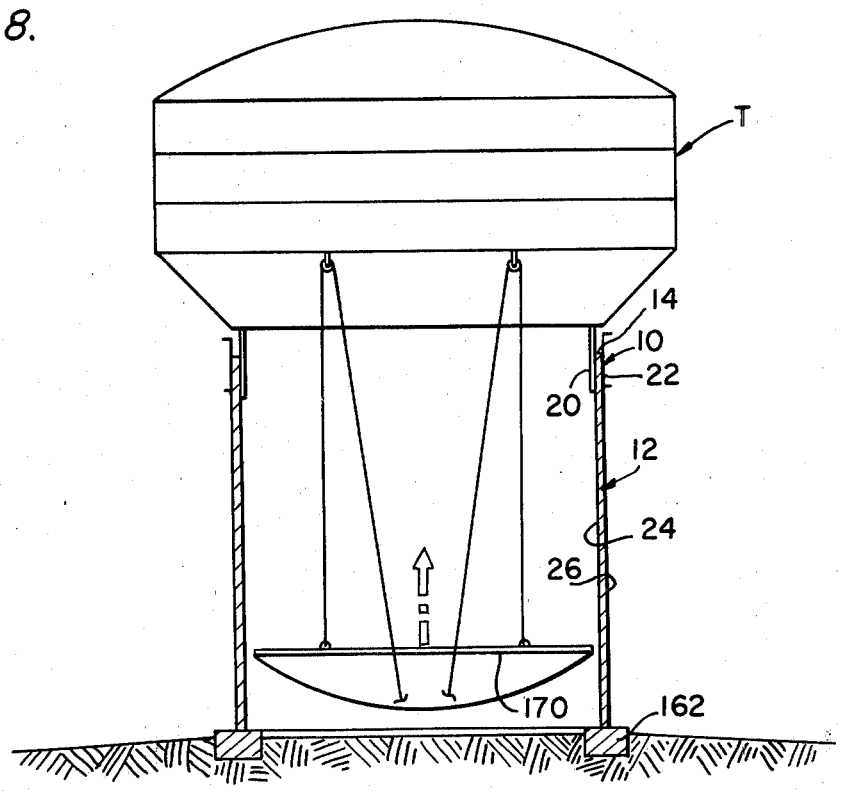
Figure 9:
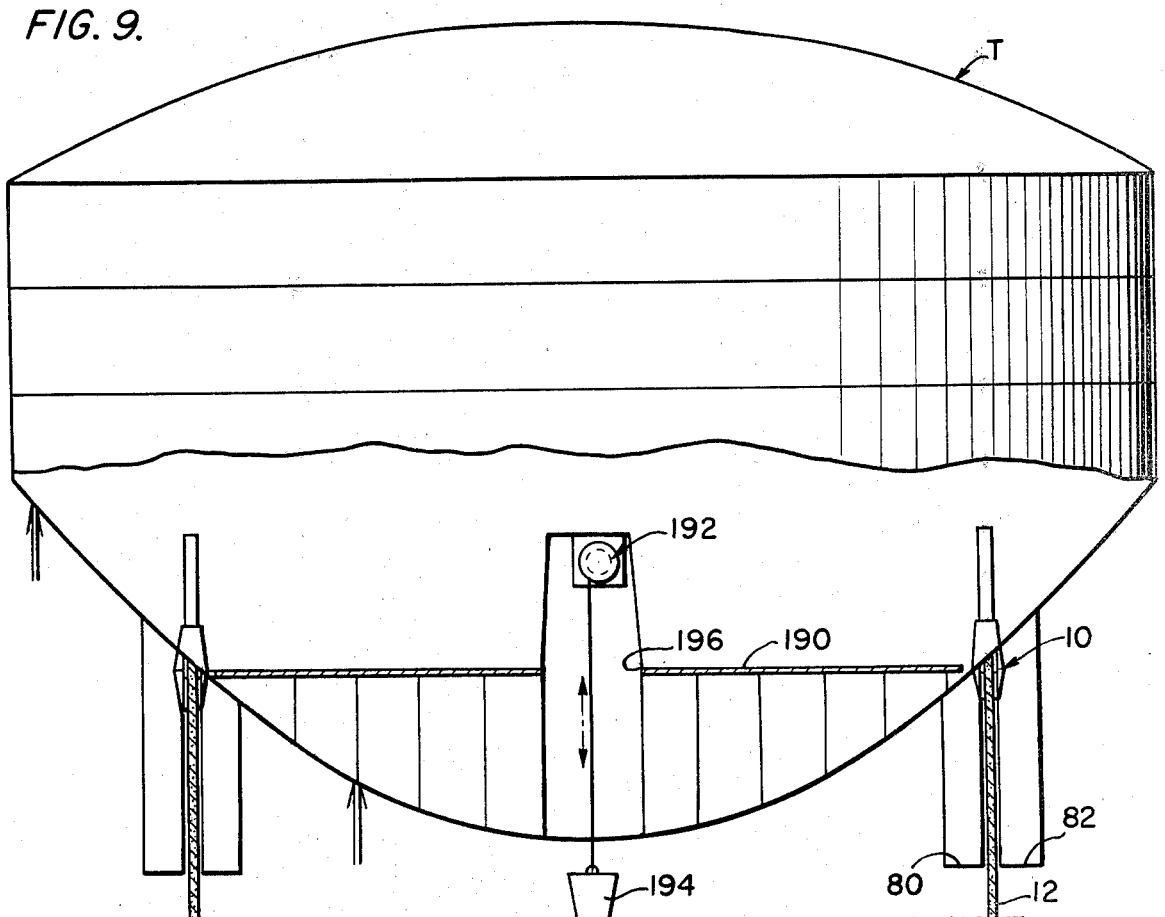
FIG. 9 is an elevation view illustrating an alternative embodiment of the method of erecting an elevated tank according to the teachings of the present invention.

Schematically shown in FIGS. 4–8 is a method of erecting an elevated tank according to the teaching of the present disclosure. FIG. 1 shows equipment used in practicing the invention, and FIGS. 9 and 10 show an alternative form of the method.

As discussed above, the essence of the invention is the elevation of a completed tank by formwork methods, and preferably slipform methods, with the formwork being positioned so that only the tank need be raised by mechanical means, such as jacks, or the like, which jacks are included with the formwork apparatus. The ensuing disclosure will clarify this invention.

Adverting first to FIG. 1, it is seen that the preferred equipment used to raise a completed tank T includes a slipform 10 movably mounted on a wall 12 at or near the top rim 14 thereof. As will be evident from the ensuing discussion, wall top rim 14 moves upwardly as the wall 12 is constructed.

The slipform 10 includes sheeting 20 and 22 contacting inner surface 24 and outer surface 26, respectively, of the wall 12. Wales 30 and bracing 32 reinforce the sheeting and transmit lifting forces in the manner usual to slipforms. As shown in FIG. 1, sheeting 20 includes an upper portion 36 which extends above top rim 14, and sheeting 22 includes a splash board forming portion 38.

A yoke assembly 42 includes a cross member 44 and a pair of frame members 46 and 48 associated with sheeting 20 and sheeting 22, respectively. The frames are attached to the wales and to the cross member to transmit forces to the wales and to maintain proper spacing between the sheeting members.

Figure 3:
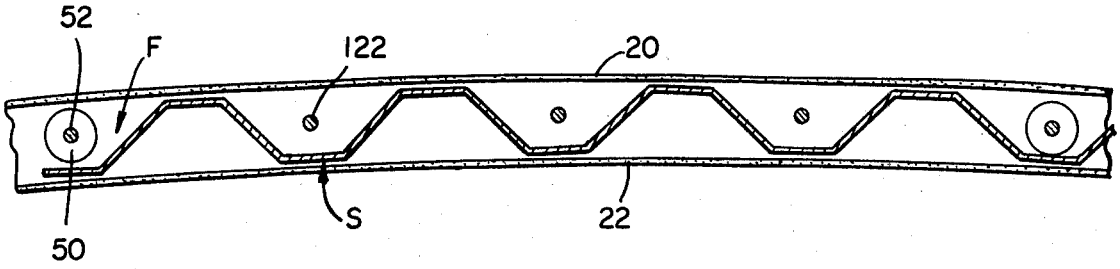
FIG. 3 is a view taken along line 3—3 of FIG. 2.

A jack 50 is mounted on the cross member 44, and includes a jacking rod 52 extending through a support guide tube 54 attached to the cross member 44. The jacking rods 52 extends downwardly through the wall 12 and have the lowermost terminal ends thereof resting on the ground located footing, or the like. Vertical reinforcement bars are located between the jacking rods, and both the jacking rods and vertical reinforcement bars are formed of a plurality of sections which are placed end-to-end as the wall is erected. The jack 50 is suitably powered from a suitable source (not shown). The jack can be a screw-type, hydraulic, pneumatic, or the like, as suitable. There are a plurality of jacks each located in a flute F of the tank fluted skirt, as best shown in FIG. 3. The jacks thus create stresses which are directed essentially linearly through the jack into the support wall as the tank is elevated. The mechanical advantage of such stress distribution permits use of jacks which are smaller than those required if the tank were lifted using some other distribution of hoisting equipment.

A wheel 60 is supported from the inner frame member 48 via frame extensions 62 and 64 to contact the wall inner surface 24. The wheel serves to transfer lateral forces into the hardened concrete of the wall. The wheel transfers laterally directed wind forces into the wall.

Cross bracing 70 is connected to tank T and to yoke frame member 48. The cross bracing distributes forces and supports the slipform in a manner known to those skilled in the art.

Also included is inner platform 80, outer platform 82 and finishing platform 84, all supported from cleats 86 on the tank T via cables 89, with platforms 80 and 82 also being attached to the slipform 10. The platforms serve purposes usual to this art. The finishing platform supports workmen performing the usual finishing operations and is hung in place after slipping commences. The finishing platform can be enclosed and heated in cold weather, if desired. The inner platform 80 is used for placement of the vertical reinforcement bars in the wall.

It is noted that if extra head room is required at the inside work platform (for example, in placement of heavy reinforcement bars for Zone 3 seismic loads), the height of the tank skirt can be increased by blocking the tank up on a foundation slab. Slipforms may be positioned after tank completion. The tank falsework should be self-supporting to avoid damage thereto when slipforming commences.

It is also noted that the work platforms should be integral with the slipform during the slipping operation. However, these platforms should be detachable so that they can be lowered independently using "window washing" type cable jacks. These platforms can then be used to dismantle the slipforms at the top of the pedestal and then lowered for dismantling at ground level.

Any suitable means for transporting concrete, reinforcement bars, and the like, to the slipform work area can be used. One such means is shown in FIG. 1 and includes a monorail assembly 100. The monorail assembly 100 includes a rail 102 mounted on the tank and a carriage 104 riding in the rail 102. Cable 106 includes reaches 108 and 110 and is trained around a pulley 112 in the carriage and a pulley 114 mounted on the ground.

Concrete from a source (not shown) is moved in buckets, or the like, to the level of the outside platform. Workmen than decant the concrete into the slipform gap 120 formed between the sheeting members. Vertical reinforcement bars 122 and horizontal reinforcement bars 124 are embedded as suitable.

As is evident from the above, the slipform and all of the equipment associated therewith is affixed to the tank T to move therewith. A multiplicity of jacks 50 are placed and spaced circumferentially about the tank T and lift that tank as work progresses. As one level of the wall 12 hardens sufficiently, the tank and attached slipform equipment are raised by the jacks 50 so the next wall level can be poured.

Work progresses until the tank T has been raised to a suitable height. At such time a closure pour is performed using a closure form 130 attached to upper portion 36 of sheeting 20 shown in phantom lines in FIG. 1 to indicate that this closure form is detachably mounted on the sheeting 20 when the closure pour is to be executed and is not present at other times.

The tank has a fluted skirt S appended thereto and the jacks 50 are located in the flutes on the skirt as shown in FIGS. 1 and 3. The cross members 44 also support the vertical reinforcement bars and the jacking rods.

Figure 2:
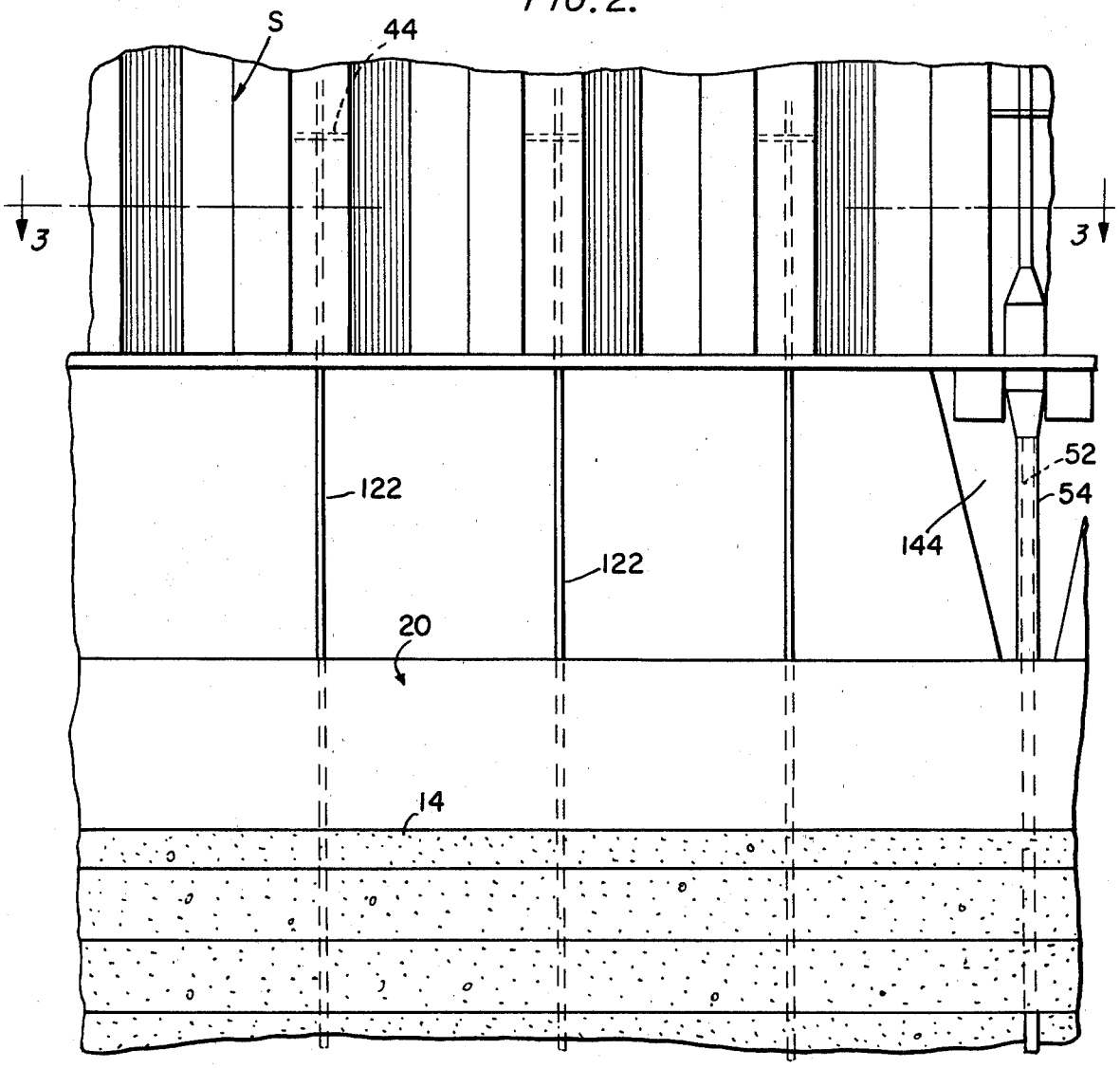
FIG. 2 is a partial elevation view of an elevated tank which has been completed according to the method embodying the teachings of the present invention.

As best shown in FIG. 2, a gap or blockout 144 is left in the closure port to allow removal of the yoke means, jack means, the support tube 54, and the like.

As can be seen, the slipform means is affixed to the tank T via the yokes, cross braces and platforms, and hence moves with that tank. The tank is moved upwardly as the wall is completed, and hence is carried upwardly as work progresses. The jacks 50 thus need only lift the tank, slipforms, platforms, and the like. The weight of the wall 12 need not be lifted by the jacks.

Figure 4:
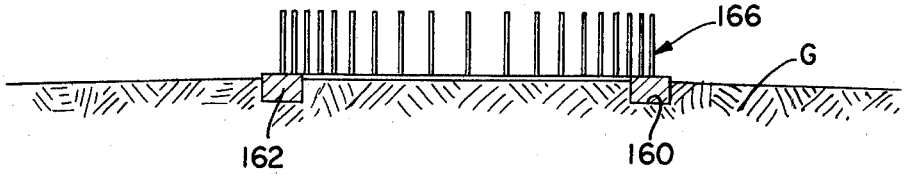
FIGS. 4–8 are schematic views illustrating the method of erecting an elevated tank according to the teachings of the present invention.

FIGS. 4–8 illustrate the method of erection disclosed herein. Erection is begun by dfining an excavation 160 at a suitable location in groundG and forming a footing 162 therein. Falsework 166, anchor bolts and the like are mounted in the footing as shown in FIG. 4. Suitable bracing and the like is also erected. The anchor bolts 70 temporarily hold the tank, and tierods or the like for the concrete wall are also cast in place in the footing.

Figure 5:
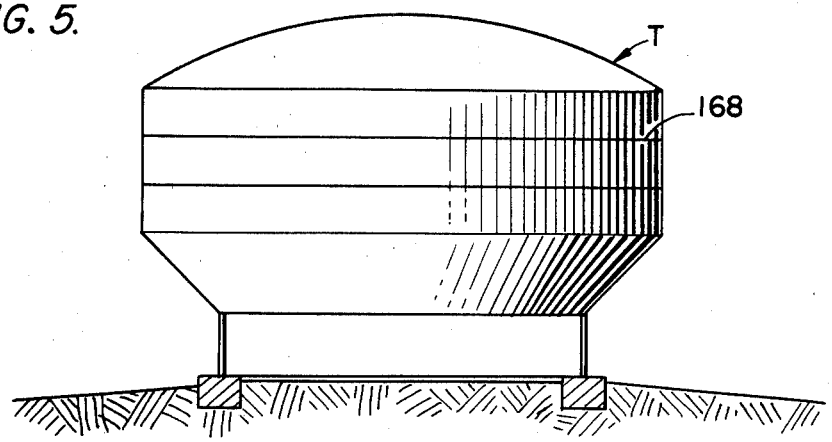
Figure 6:
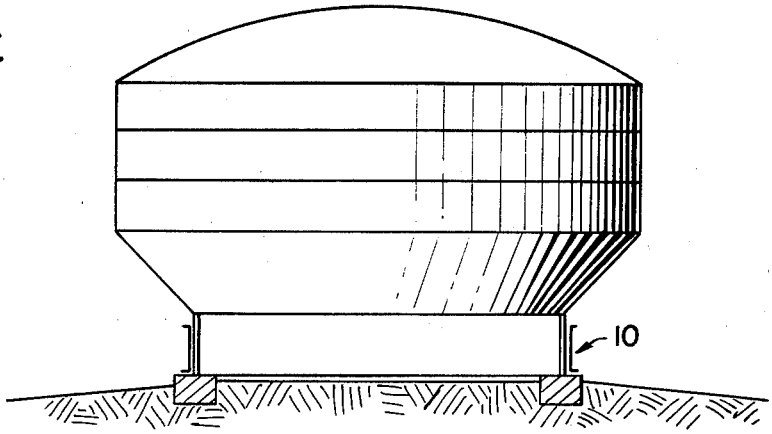

The tank T is then formed on the falsework as shown in FIG. 5, and has suitable compression rings 168 thereon. The tank is complete except for the bottom which will be formed on the ground and lifted into place after the tank has been elevated to the desired height. Bracing and the like is attached to the tank.

The slipforms, jacks and other associated equipment are then attached to the bracing and to the tank and to the falsework. Concrete is then poured into the slipform and tank elevation above the FIG. 5 level commences. Concrete can be conducted to the tank site via a wet application system WS as shown in FIG. 7, or by other suitable means, such as the above-discussed monorail assembly 100, or the like. Tank movement is indicated in FIG. 7 by arrow TM. The platforms are also suitably attached to the tank.

The tank is superincumbent the upper rim of the wall 12 as that wall is built upwardly as above discussed and is progressively elevated upwardly until the desired height thereof is reached. Such desired height is shown in FIG. 8. Tank bottom 170 is formed and then hoisted into position and suitably attached to the tank. Finish work and closure pours are performed as suitable and as will be known to those skilled in the art from this disclosure. Permanent tank anchor means are also installed at this point.

The tank is then lowered onto the permanent anchor means, the slipforms are removed where suitable, the tank base plate is grouted to the wall and the concrete surface is finished as necessary. Piping, and like equipment, is then installed. It is noted that the slipform equipment located inside the wall may be left in place, if suitable.

An alternative method of carrying out the erection method disclosed herein is illustrated in FIGS. 9 and 10. In the alternative method, a tank compression ring is modified and the slipform 10 is attached thereto in place of the tank skirt shown in the above-disclosed embodiment. The top edge of the slipform is welded to the tank.

As best shown in FIG. 10, the tank has an annular opening H defined therein. Annular reinforcement plates P1 and P2 are located on the tank along the edges of the opening. Closure plates CP cover the hole H, after slipforming. A reinforcement template TR is mounted on the tank wall and reinforcement plates, and the jack rod 52 is received through the opening in the reinforcement template. A jack 50 is mounted on the template TR.

Pouring during the slipforming is accomplished from inside the tank through the opening H with the closure plate removed. Once the wall is completed, the closure plate is welded in place, the jack is removed and the reinforcement template is dismantled. Of particular interest here is that the skirt disclosed above is replaced by the slipform and concrete pouring is initiated from inside the tank.

Preferably, the slipforms remain in place after the tank has reached the desired height.

A platform 190 is affixed to the tank T to span the bottom of that tank. A hoist mechanism 192 is mounted in the tank and concrete is transported in a bucket 194 via an access hole 196 in the platform to the tank and then to the slipform from inside the tank.

In the alternative method, the wall is formed to an intermediate height before tank construction is begun. However, once the tank is formed, the procedure is similar to the procedure described above with reference to FIGS. 4–8.

When the tank has attained the desired height, the yoke means are removed and a closure plate is welded in the tank to cover the concrete wall. The slipforms, preferably, are left in place and not removed upon completion of the FIG. 9 tank erection method. Reinforcement bars as well as concrete and other material are hoisted to the work area by the hoist mechanism 192.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A method of erecting an elevated tank comprising steps of:

positioning a tank support means on a ground located footing;

forming a tank on said ground-mounted tank support means;

attaching formwork apparatus to said tank, said formwork apparatus including a plurality of jacking mechanisms, said jacking mechanisms being connected to said tank;

forming a support wall using formwork apparatus; and elevating said tank simultaneously with said support wall formation using said formwork jacking mechanisms to lift said tank as said wall is formed, said tank remaining coupled to said support wall via said formwork apparatus during formation of said support wall and being carried upwardly by said support wall as said support wall moves upward during formation thereof.

2. The method of erecting an elevated tank defined in claim 1 further including steps of forming a tank bottom and elevating said tank bottom to said tank.

3. The method of erecting an elevated tank defined in claim 2 further including a step of elevating said tank bottom after said tank has been elevated to a desired height.

4. The method of erecting an elevated tank defined in claim 1 further including steps of attaching a concrete hoisting means to said tank and elevating concrete to said formwork apparatus using said hoisting means.

5. The method of erecting an elevated tank defined in claim 4 wherein said hoisting means is attached to an exterior surface of said tank.

6. The method of erecting an elevated tank defined in claim 4 wherein said hoisting apparatus is located inside said tank.

7. The method of erecting an elevated tank defined in claim 1 further including a step of effecting a closure pour to complete said support wall after said tank has attained a desired height.

8. The method of erecting an elevated tank defined in claim 7 further including a step of defining gaps in said closure pour.

9. The method of erecting an elevated tank defined in claim 1 further including a step of setting reinforcement means in said support wall during said support wall forming step.

10. The method of erecting an elevated tank defined in claim 1 further including a step of attaching a guide wheel apparatus to said slipform apparatus.

11. The method of erecting an elevated tank defined in claim 1 further including a step of attaching a fluted skirt to said tank.

12. The method of erecting an elevated tank defined in claim 11 wherein said jacking mechanisms are located in the flutes of said skirt.

13. The method of erecting an elevated tank defined in claim 1 further including steps of attaching bracing to said tank and attaching said bracing to said formwork apparatus to attach said formwork apparatus to said tank.

14. The method of erecting an elevated tank defined in claim 1 further including a step of attaching work platforms to said tank.

* * * * *